US007063096B2

(12) United States Patent
Stoeckler

(10) Patent No.: US 7,063,096 B2
(45) Date of Patent: Jun. 20, 2006

(54) SIDE COVER FOR A COLLAPSIBLE TENT

(76) Inventor: Heinz Stoeckler, Frohwiesstrasse 37, Ruti ZH (CH), CH-8630

( * ) Notice: Subject to any disclaimer, the term of this patent is extended or adjusted under 35 U.S.C. 154(b) by 0 days.

(21) Appl. No.: 10/346,674

(22) Filed: Jan. 15, 2003

(65) Prior Publication Data

US 2004/0134529 A1 Jul. 15, 2004

Related U.S. Application Data

(63) Continuation of application No. PCT/CH01/00455, filed on Jul. 23, 2001.

(30) Foreign Application Priority Data

Jul. 26, 2000 (CH) ..... 1479/00

(51) Int. Cl.
*E04H 15/60* (2006.01)

(52) U.S. Cl. ..... 135/114; 119/121; 52/222; 403/331

(58) Field of Classification Search ..... 246/122.1, 246/125.8; 52/222, 63; 135/119, 114, 121, 135/117; 403/331
See application file for complete search history.

(56) References Cited

U.S. PATENT DOCUMENTS 3,160,249 A * 12/1964 Pavlecka ..... 52/586.2
3,848,844 A * 11/1974 Barrett ..... 248/245
4,142,343 A * 3/1979 Trafton ..... 52/736.2
4,194,338 A * 3/1980 Trafton ..... 52/736.2
4,493,172 A * 1/1985 Jones ..... 52/282.2
4,669,908 A * 6/1987 Simone et al. ..... 403/170
4,887,626 A * 12/1989 Dalo et al. ..... 135/119
4,941,763 A * 7/1990 Euteneuer ..... 403/3
5,175,971 A * 1/1993 McCombs ..... 52/736.2
5,263,296 A * 11/1993 Spera ..... 52/638
5,269,619 A * 12/1993 Warkus et al. ..... 403/240
5,379,566 A * 1/1995 Schworer ..... 52/632
5,474,501 A * 12/1995 Teng ..... 472/62
5,613,543 A * 3/1997 Walton ..... 160/265
5,732,755 A * 3/1998 Cross ..... 160/57
5,791,806 A * 8/1998 Giehl ..... 403/117
5,899,423 A * 5/1999 Albertini ..... 248/188.8
5,941,399 A * 8/1999 Wang ..... 211/187
D415,574 S * 10/1999 Shrira ..... D25/61
5,979,119 A * 11/1999 Trafton ..... 52/40
6,032,433 A * 3/2000 Hatziathanasiou ..... 52/742.12
6,418,949 B1 * 7/2002 Lin et al. ..... 135/25.1
6,422,407 B1 * 7/2002 Arai ..... 211/189
6,481,177 B1 * 11/2002 Wood ..... 52/656.9
D473,663 S * 4/2003 Chou ..... D25/122
6,547,088 B1 * 4/2003 Wang ..... 211/187
6,554,235 B1 * 4/2003 Fortier ..... 248/122.1
6,682,255 B1 * 1/2004 Battaglia et al. ..... 403/381
6,682,256 B1 * 1/2004 Hor ..... 403/382

* cited by examiner

*Primary Examiner*—Anita King
*Assistant Examiner*—Amy J. Sterling
(74) *Attorney, Agent, or Firm*—Gene W. Arant

(57) ABSTRACT

A side cover structure for a collapsible tent includes a fabric side cover that is vertically suspended between two post. Each post has inner and outer pole sections that are telescopically engaged. Each pole section has exterior longitudinal grooves. The fabric side cover has beads or flanges, sometimes referred to as keder-profile, which are slidably inserted into those longitudinal grooves for securing the cover in place.

4 Claims, 2 Drawing Sheets

SIDE COVER FOR A COLLAPSIBLE TENT

PRIORITY CLAIM

This application claims priority of Swiss Patent Application No. 1479/00 filed Jul. 26, 2000, and PCT Application No. WO 02/08549 A1 filed Jul. 23, 2001.

CROSS REFERENCE TO RELATED APPLICATION

This application is a continuation of PCT patent application No. PCT/CH01/00455, filed on Jul. 23, 2001. The priority of the prior application is expressly claimed and their disclosure is herby incorporated by reference in the entirety.

FIELD OF THE INVENTION

The field of this invention is collapsible tent structures.

SUMMARY OF THE INVENTION

According to the present invention a side cover made of fabric or keder 7 with an edge bead or flange or keder-profile 8 or 9 is supported in a vertical position between two corner posts, each of which has an outer pole section 1 and an inner pole section 2. The pole sections are engaged in a vertically telescoping relationship.

Each outer pole section 1 is hollow and has a generally octagonal peripheral wall with four circumferentially spaced ribs 3 that extend inwardly and longitudinally, forming outwardly opening grooves. The grooves formed by ribs 3 have a cross-sectional opening of somewhat more than 180 degrees, thus forming sharp longitudinal edges 5.

Each inner pole section is essentially hollow with an octagonal peripheral wall and has four circumferentially spaced outwardly opening grooves 4 that are larger than the ribs 3 of the outer pole section, and extend longitudinally of the inner pole section. The grooves 4 have an arcuate cross-sectional opening of somewhat more than 180 degrees, forming sharp longitudinal edges 6.

The ribs 3 of the outer pole section 1 are adapted to be slidably received by the grooves 4 of the inner pole section 2 for telescoping movement of the two pole sections relative to each other. The flat side surfaces 11 of the two pole sections are then in mutually slidable engagement.

The bead or flange or keder-profile 8 or 9 of the side cover 7 is longitudinally slidable within a groove 3 or 4 on the outward side of either outer pole section. In the extended position of the pole sections shown in FIG. 2 the bead or flange or keder-profile 9 requires an adapter 12 to securely fit within an exposed longitudinal portion of groove 4 of the inner pole section, so that the side cover edge may be securely supported by both pole sections at the same time. The adapter or rail 12 preferably has the shape of about a three-quarter cylinder.

ALTERNATE DESCRIPTION

The invention refers to a side cover for a collapsible tent according to the preamble of the first claim.

Collapsible tents preferably refers to tents comprising tube-shaped edge poles being telescopically movable in each other. Such tents with four edges are, as an example, described in EP-A-0 514 574 and are sold under the trade name "Pro*Tent". A design with six edges has been described in the Swiss Patent Application No. 0986/97 of May 02, 1997.

FIG. 5 of the patent EP-A-0 514 574 referred to, shows a possible design of such a side cover, in which the covers for two adjacent side walls have been connected by means of adhesive strips. This kind of connection has the drawback, that it loosens quite easily, if strong wind is allowed to act on the tent, what is quite common, if the tent is set up in open air, such as an garden.

A further disadvantage is the fact, that it is relative time-consuming to arrange the side cover in such a way, that they make a favorable impression on the viewer. In case of wind blowing continiously it is important, that they present an aesthetic appearance. The correct arrangement of the different side covers is in addition very time-consuming. A further disadvantage is the fact that no possibility has been provided to cover only the lower portion of the side wall, if the tent, as-an example, is used in the market place, so that the upper portion of the side wall is open to allows clients to view the products offered.

The object of the invention is therefore to design a side cover of the kind described in the introductory portion, that does not possess the disadvantages of the prior art referred to.

This object has in accordance with the invention been achieved by the features listed in the characterizing portion of the first claim.

Embodiments of the invention have been listed in the dependent claims.

The solution described uses a so-called keder-profile, which is defined as the strengthening rim, edge or border of leather or plastic.

The keder-profile is a border thickening that is kept in a channel or groove in a rail and is held therein due to its shape. The opening slot for the side cover is thereby much more narrow than the cross-sectional area for the receipt of the keder profile.

In the following an embodiment of the subject of the invention is explained with reference to the drawing, in which FIG. 1 shows a section through two telescopically in each other movable edge-post portions;

Figure 1:
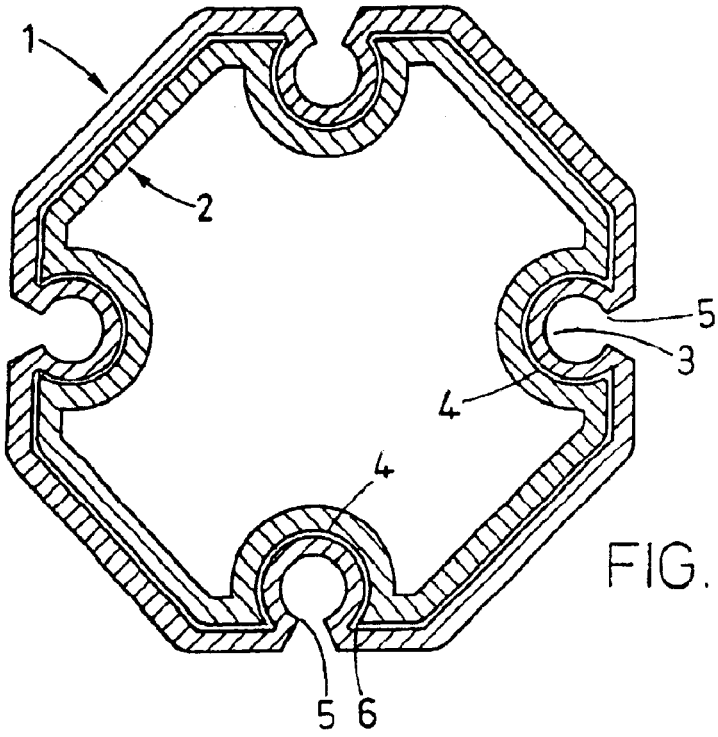
Figure 5:
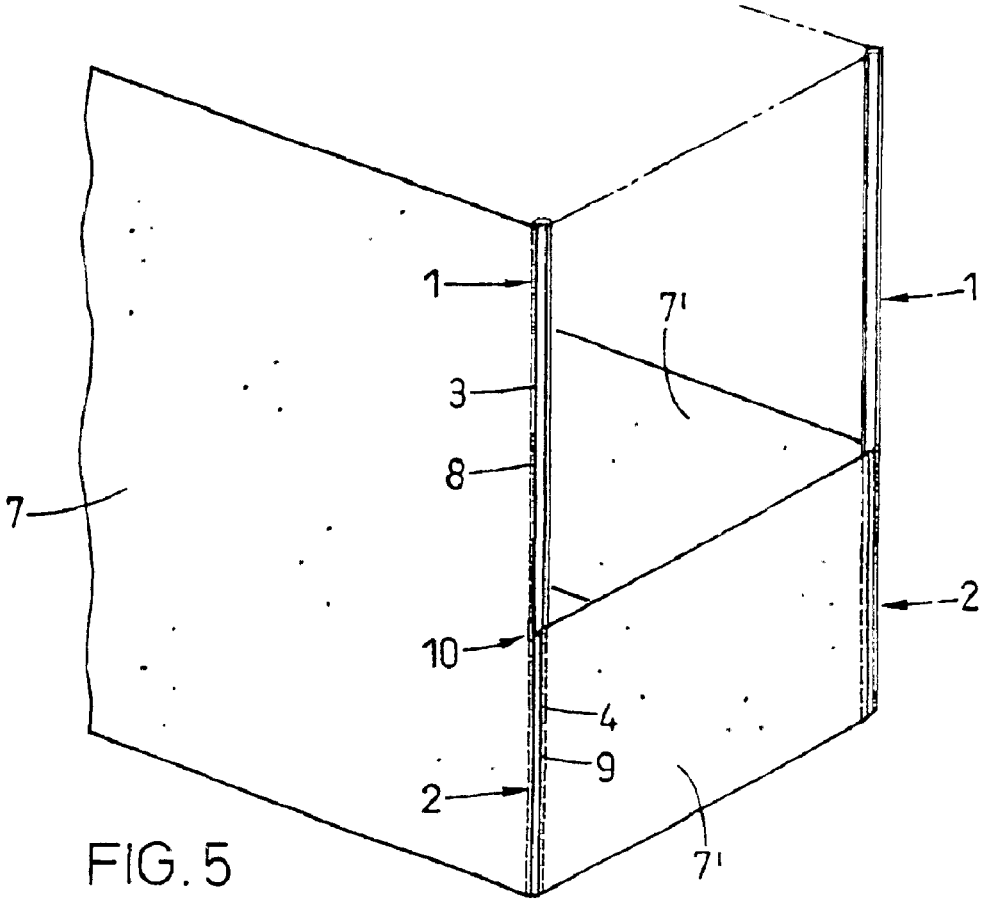
FIG. 5 shows edge posts with inserted side wall.
Figure 2:
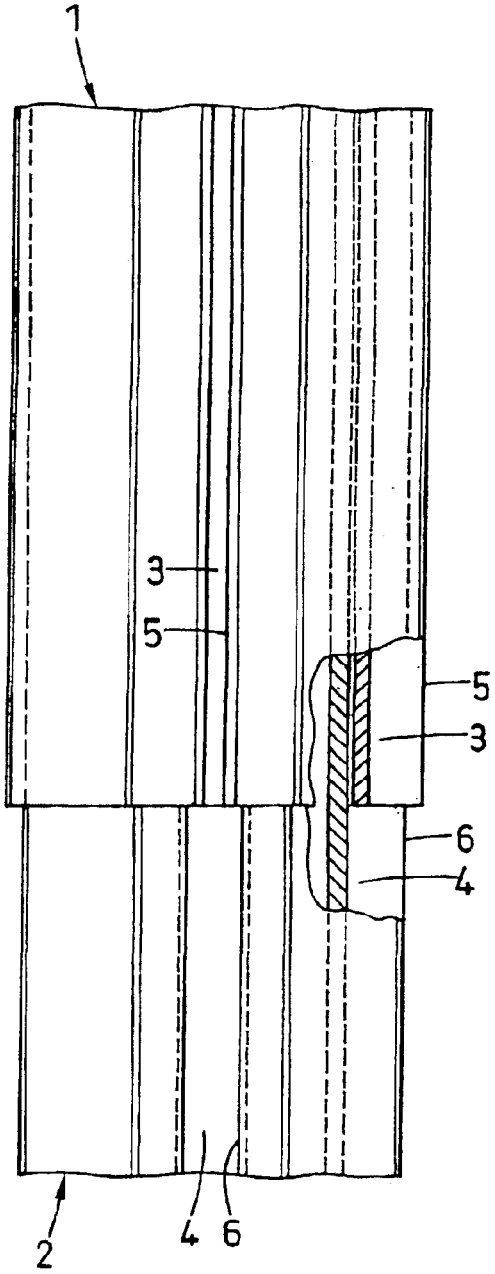
FIG. 2 shows a side view of the edge-post portions at the transition from the upper to the lower post portion.

FIG. 1 shows a section through the edge post sections 1 and 2 being movable telescopically within each other, in which the upper portion or the outer post 1 is mounted uppermost on the roof carrier, while the lower portion or the inner post 2 serves as a prolongation and extends to the floor. The upper portion 1, engaged by the lower portion 2 by means of a spring pin, has on four sides each a recess or a groove 3, which on a movement of both parts 1,2 relative to each other slides in a groove 4 in the lower portion 2. These four grooves 3 and 4 are on the outside provided with a contraction 5 and 6, so that a side cover 7 inserted in the grooves 3 and 4 slides therein and is kept due to its shape, because it is provided with the so-called keder-profiles 8 or 9, whereby 8 for the upper portion has a smaller sectional area than 9 for the lower portion.

Normally the side cover 7 extends over the entire area from the bottom to thr top, whereby in the middle of the cover 7 a transition area 10 is located between the area with a thin and a thick keder-profile. In this transition area 10 the side cover 7 is provided with an interruption of the keder-profile 8, 9, so that the side cover 7 from here can be moved down—(thick keder-profile) or upwardly (thin keder-profile).

This transition area 10 is, however, very short and has no optical disadvantage. If the side cover stops at half height, it is designated 7' instead of 7.

When the side cover is mounted, the lower portion 9 is preferably firstly moved from the transition area 10 downward and thereafter the upper portion is moved from the transition area 10 upward. When the entire side cover 7 is mounted, it is secured by means of an adhesive tape, as an example.

In order that this transition area 10, as far as the side wall cover is concerned, can be entirely avoided, a rail 12 with so-called film-joint, extending in the longitudinal direction, can be inserted in the lower area. This rail 12 has in the inner portion the same section area as the upper recess, so that an interruption due to the two keder-profiles with different thickness is not necessary. In this case the keder-profile has the same sectional area from the bottom to the top, what simplifies the production of the side cover considerably.

The edge posts are preferably made of light metal or aluminum, respectively, but can also be made of suitable plastic. A post design having eight edges has proved to have a very high strength. The side cover is likewise preferably made of plastic, although any kind of fabric is well suited, if so required by a client. It is also possible to deliver a tent with several side walls of different design and color, which can be applied to the tent, as required by the client.

By means of the proposed solution it is possible to tighten the wall of the tent against wind pressure. For the insertion of the side cover, the transition area 10 has been arranged half distance from the bottom of the side cover 7, in which area 10 the upper thin keder-profile change to the lower thick keder-profile. In this area both halves of the side covers are inserted and are pulled up—or downward.

This area 10 has a length of about 2–3 cm and does not influence the wind tightness of the tent due to this short length.

When a rail 12 is used, it is still recommendable to maintain the transition area, despite the fact, that the keder-profile in this case has the same thickness over the entire height.

When the side cover is inserted, it is firstly hanged on the roof blind and provisionally fastened there by means of adhesive tape. Thereafter the lower portion of the side cover is inserted and secondly the upper end loosened from the roof blind and pulled from the half height upward and again secured to the roof blind.

Figure 3:
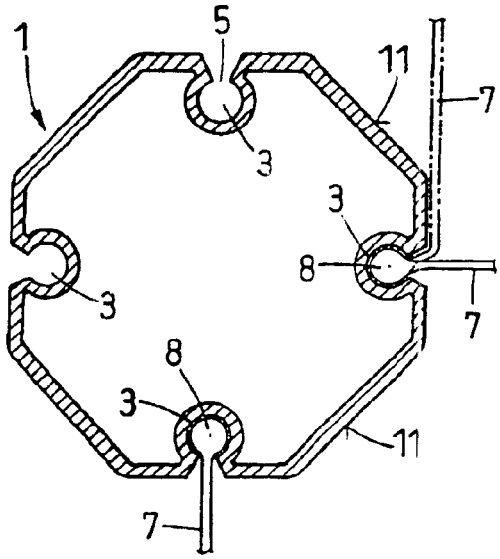
FIG. 3 shows a section through the upper portion.
Figure 4:
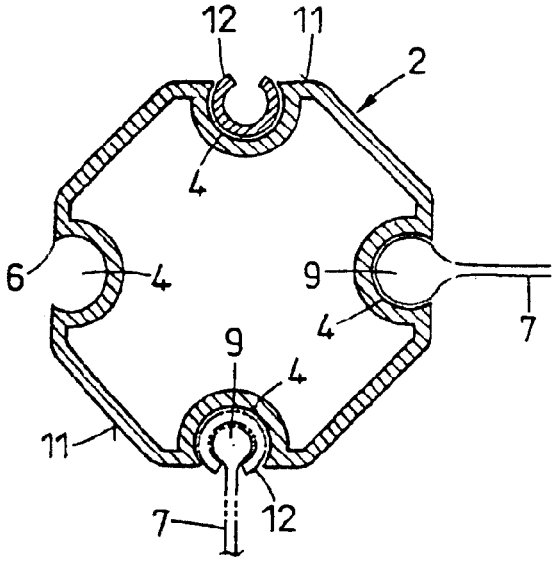
FIG. 4 shows the same as FIG. 3, but through the lower portion.

As explained in connection with FIGS. 3 and 4, the covers can either run straight or radially from adjacent grooves 3,4, so that only one quarter of the circumference of the posts come to be in the interior of the tents. It is also possible to wind the side cover half around the posts, so that three quarter of said circumference come to be inside the tent/FIG. 3). This last mentioned design variation has the advantage, that two grooves are inside the tent, so that they e.g. can be used for the insertion of a plate or shelve. This design is especially suitable for expositions for dividing the space in several compartments or rooms for discussions with clients. In this case further inner posts can be placed within the tent. Furthermore, dividing covers with zip-fasteners can be used to divide the tent interior into small compartments.

The inner grooves can also be used for holding halogen lamps or decorative gadgets.

Attention is drawn to the fact, that the keder-profiles are welded in plastic films, which has one double flag consisting of two parallel arranged plastic films. The material of the side cover can be inserted between these two flag portions and be secured by welding therebetween.

In the drawing, the section between the keder-profiles 8, 9 is shown to be a circle. These profiles can also have a number of other cross-sections, as f. e. oblong, T-shaped or U-shaped. It is important that the cover engages both posts, so that the edges in the case of wind or rain tight.

What I claim is:

1. A collapsible tent having corner posts and at least one side cover, comprising:

a pair of corner posts, each having vertically telescoping inner and outer pole sections with flat side surfaces;

each outer pole section being hollow with a generally octagonal peripheral wall, having four circumferentially spaced ribs that extend inwardly and form longitudinally outwardly opening grooves, the grooves having an opening whose cross-section is more than 180 degrees thus forming sharp longitudinal edges;

each inner pole section being essentially hollow with a generally octagonal peripheral wall having four circumferentially spaced outwardly opening grooves that are larger than the ribs of the outer pole section and which extend longitudinally of the inner pole section, the grooves of the inner pole section also having an opening whose cross-section is more than 180 degrees thus forming sharp longitudinal edges;

the ribs of the outer pole section being slidably received by the grooves of the inner pole section for telescoping movement of the pole sections relative to each other, the flat side surfaces of the two pole sections being then in mutually slidable engagement;

a fabric side cover with beaded edges supported in a vertical position between two corner posts, one vertical portion of the beaded edge being slidably received within a groove on the outward side of each pole section when the pole sections of each corner post are extended;

an adapter with a cross-sectional configuration which is about a three-quarter cylinder fitted within an exposed longitudinal portion of a groove of each inner pole section; and another vertical portion of the beaded edge being slidably received within the adapter so that the side cover edge may be securely supported by both pole sections at the same time.

2. In a collapsible tent, a supporting and side cover structure comprising:

a pair of corner posts, each having two vertically telescoping pole sections;

a fabric side cover extending vertically between and cooperatively supported by the corner posts, the side cover having vertically extending beaded edges;

each post having an outer pole section which is hollow and has at least four circumferentially spaced ribs that extend inwardly and longitudinally of the outer pole section, the ribs also forming outwardly opening grooves;

each post also having an inner pole section that is essentially hollow with a peripheral wall having on its outer surface at least four circumferentially spaced outwardly opening groves that are larger than the ribs of the outer pole section, and extend longitudinally of the inner pole section;

the ribs of the outer pole section being being slidably received by the grooves of the inner pole section for telescoping movement of the pole sections relative to each other;

the beaded edge of the side cover being longitudinally slidable within a groove on the outward sides of the ribs of the outer pole section; and an adapter having the shape of about a three-quarter cylinder fitted within an exposed longitudinal portion of a groove of the inner pole section for accommodating a bead of the side cover edge, so that when the pole sections are extended the side cover edge may be securely supported by both pole sections at the same time.

3. The supporting and side cover structure of claim 2 wherein both pole sections are of uniform cross-sectional configuration throughout their length.

4. The supporting and side cover structure of claim 2 wherein the outer pole section has four ribs and the inner pole section has four grooves, the two pole sections also having four flat surfaces that slidingly engage each other.

* * * * *